US008335464B2

(12) United States Patent
Pickering et al.

(10) Patent No.: US 8,335,464 B2
(45) Date of Patent: Dec. 18, 2012

(54) CLEANING BRUSH FOR ELECTROSTATOGRAPHIC APPARATUS

(75) Inventors: Jerry A. Pickering, Hilton, NY (US); Kurt E. Jones, Webster, NY (US); Patrick M. Lambert, Rochester, NY (US); Peter S. Alexandrovich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 179 days.

(21) Appl. No.: 12/827,325

(22) Filed: Jun. 30, 2010

(65) Prior Publication Data

US 2012/0003022 A1 Jan. 5, 2012

(51) Int. Cl.
*G03G 21/00* (2006.01)

(52) U.S. Cl. ..... 399/354

(58) Field of Classification Search ..... 399/100, 399/101, 287, 326, 353, 354; 430/119.8, 430/119.85

See application file for complete search history.

(56) References Cited

U.S. PATENT DOCUMENTS

| | | | | |
|---|---|---|---|---|
| 3,692,402 | A * | 9/1972 | Solarek | 399/287 |
| 3,780,391 | A * | 12/1973 | Leenhouts | 15/1.51 |
| 3,884,185 | A * | 5/1975 | Liebman | 399/287 |
| 4,095,980 | A | 6/1978 | Satomi | |
| 4,097,140 | A | 6/1978 | Suzuki et al. | |
| 4,127,327 | A | 11/1978 | Rezanka | |
| 4,263,390 | A | 4/1981 | Yamashita et al. | |
| 4,319,831 | A | 3/1982 | Matsui et al. | |
| 4,402,103 | A | 9/1983 | Yanagawa et al. | |
| 4,506,975 | A | 3/1985 | Shukuri et al. | |
| 4,530,597 | A | 7/1985 | Itaya et al. | |
| 4,618,250 | A | 10/1986 | Noguchi et al. | |
| 4,706,320 | A | 11/1987 | Swift | |
| 4,755,853 | A | 7/1988 | Shimizu et al. | |
| 4,786,943 | A | 11/1988 | Fukae et al. | |
| 4,835,807 | A | 6/1989 | Swift | |
| 4,994,863 | A | 2/1991 | Reynolds | |
| 5,084,735 | A | 1/1992 | Rimai et al. | |
| 5,187,526 | A | 2/1993 | Zaretsky | |
| 5,196,887 | A | 3/1993 | Hilbert et al. | |
| 5,212,530 | A | 5/1993 | Harada et al. | |
| 5,282,008 | A | 1/1994 | Ellingham et al. | |
| 5,370,961 | A | 12/1994 | Zaretsky et al. | |
| 5,416,572 | A | 5/1995 | Kolb et al. | |
| 5,508,879 | A | 4/1996 | Kitamura et al. | |
| 5,600,405 | A | 2/1997 | Umeda et al. | |

(Continued)

FOREIGN PATENT DOCUMENTS

| | | |
|---|---|---|
| JP | 52-013343 | 2/1977 |

(Continued)

*Primary Examiner* — Robert Beatty
(74) *Attorney, Agent, or Firm* — Andrew J. Anderson

(57) ABSTRACT

A cleaning brush for use in an electrostatographic imaging apparatus, including a plurality of individual electrically conductive fibers secured to a brush core and having fiber tips relatively remote from the brush core, wherein the cleaning brush includes an electrically conductive plane at a surface of the brush core, or between a surface of the brush core and the electrically conductive fibers, effective for inducing an electrical potential to the conductive fibers when an electrical potential is applied to the electrically conductive plane, and at least one of a relatively non-conductive layer electrically insulating the conductive plane from the conductive fibers, or electrically insulating coatings on tips of the electrically conductive fibers remote from the brush core. The insulative, or non-conductive, layer between the fibers and the conductive plane of the brush prevent excessive current draw.

8 Claims, 7 Drawing Sheets

U.S. PATENT DOCUMENTS

| | | | | |
|---|---|---|---|---|
| 5,689,791 | A | 11/1997 | Swift | |
| 5,905,932 | A | 5/1999 | Morse et al. | |
| 6,009,301 | A | 12/1999 | Maher et al. | |
| 6,073,294 | A * | 6/2000 | Mashtare et al. | 15/1.51 |
| 2007/0003336 | A1 * | 1/2007 | Ninomiya et al. | 399/346 |

FOREIGN PATENT DOCUMENTS

| | | | |
|---|---|---|---|
| JP | 56-149078 | | 11/1981 |
| JP | 60032073 | A * | 2/1985 |
| JP | 60086582 | A * | 5/1985 |
| JP | 60170878 | | 9/1985 |
| JP | 60205550 | | 10/1985 |
| JP | 61-073984 | | 4/1986 |
| JP | 01-116678 | | 5/1989 |
| JP | 04-093974 | | 3/1992 |
| JP | 05061395 | A * | 3/1993 |
| JP | 05-188836 | | 7/1993 |

* cited by examiner

CLEANING BRUSH FOR ELECTROSTATOGRAPHIC APPARATUS

FIELD OF THE INVENTION

The present invention relates to a cleaning member for an electrostatographic imaging apparatus and methods and in particular to cleaning remnant toner and magnetic carrier particles from a toner bearing member in such an apparatus.

DESCRIPTION RELATIVE TO THE PRIOR ART

In electrostatographic imaging apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternative, a light beam may be modulated and used to selectively discharge portions of the charged photoconductor surface to record the desired information thereon. Typically, such a system employs a laser beam or LED printhead. Subsequently, the electrostatic latent image on the photoconductive insulating surface is made visible by developing the image with developer powder referred to in the art as toner or dry ink. Most development systems employ developer which comprises both electrostatically charged magnetic carrier particles and electrostatically charged toner particles. The toner particles triboelectrically adhere to the carrier particles. During development, the toner particles are attracted from the carrier particles by the charged pattern of the image areas of the photoconductive insulating area to form a powder image on the photoconductive area. This toner image may subsequently be transferred to a support surface such as a paper receiver to which it may be permanently affixed by the application of heat, pressure, or a combination of the two. For enhanced image reproduction and in respect to color reproducing apparatus, it is known to transfer the toner image to an intermediate transfer member and then to the receiver.

Commercial embodiments of the above general process have taken various forms and in particular various techniques for cleaning the photoconductive insulating member have been used. Additionally, cleaning of the intermediate transfer member (ITM) involves unique challenges since the preferred ITMs tend to be semiconductive whereas the photoconductors are, as noted above, insulative.

In the electrostatographic imaging art, the use of fiber brushes has been relatively standard. Fiber brushes rotated in close physical contact having an electrical bias or without a bias have been described in U.S. Pat. Nos. 4,835,807 (Swift) and 4,097,140 (Suzuki et al). Brushes with conductive fibers have also been described, i.e. U.S. Pat. No. 4,319,831 (Matsui et al). In Matsui et al., a metal support (brush core) is described, wherein the metal support is grounded to the conductive fibers.

One particularly advantageous method uses an inductively coupled fiber cleaning brush and is described in U.S. Pat. No. 6,009,301 (Maher et al.). In Maher et al., there is a cleaning brush comprising a plurality of individual brush fibers, the fibers each including an electrically conductive core and a surrounding relatively nonconductive annular portion; and an electrically conductive backing securing the fibers and adapted to induce an electrical potential to the core of the fibers when an electrical potential is applied to the conductive backing, the conductive backing further preferably being coated with a carbon-filled conductive latex paint. In such brush, the conductive backing and paint is insulated from the electrically conductive cores of the fibers only by the surrounding relatively non-conducting annular portions of the brush fibers. An electrically-biased detoning roller is typically employed in combination with a cleaning brush for removing toner from the brush, where the detoning roller is electrically biased to a higher voltage level and of the same polarity as the cleaning brush to maintain an electrical field for attracting toner from the brush to the detoning roller.

SUMMARY OF THE INVENTION

Current draw by the brush in inductively coupled fiber cleaning brushes of the prior art employing a conductive backing has been found to complicate voltage control of the detone roller due to excessive conductivity. The current invention provides an insulative, or non-conductive, layer between the fibers and a conductive plane of the brush, thereby preventing excessive current draw when the brush is constructed using fibers that would otherwise cause excessive current draw in the brush of the prior art.

In accordance with a first aspect of the invention, there is provided a cleaning brush for use in an electrostatographic imaging apparatus, comprising a plurality of individual electrically conductive fibers secured to a brush core and having fiber tips relatively remote from the brush core, wherein the cleaning brush includes an electrically conductive plane at a surface of the brush core, or between a surface of the brush core and the electrically conductive fibers, effective for inducing an electrical potential to the conductive fibers when an electrical potential is applied to the electrically conductive plane, and at least one of a relatively non-conductive layer electrically insulating the conductive plane from the conductive fibers, or electrically insulating coatings on tips of the electrically conductive fibers remote from the brush core.

In accordance with a second aspect of the invention, there is provided an apparatus and method for cleaning residual toner from a toner-bearing surface, comprising a cleaning brush according to the invention; a toner bearing surface contacting the brush fibers; a drive for driving the cleaning brush to move the fibers relative to the toner bearing surface to scrub toner particles from the toner bearing surface; and a source of electrical potential coupled to the cleaning brush for establishing an electrical potential on the electrically conductive plane which induces an electrical potential to the fibers for electrostatically attracting toner from the toner-bearing surface to the brush.

It is surprising that with the insertion of a non-conductive layer, the brush continues to provide excellent cleaning performance. Further, the brushes of the current invention have improved robustness to variations in the fiber providing the advantage of lower tendency to draw current. This advantage provides simpler control strategies and lower systems cost. An additional advantage of reduced sensitivity to the fiber is that waste is avoided when the fiber properties vary. Yet another advantage of the current invention is reduced sensitivity to environmental variations such as increased humidity.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

Figure 1:
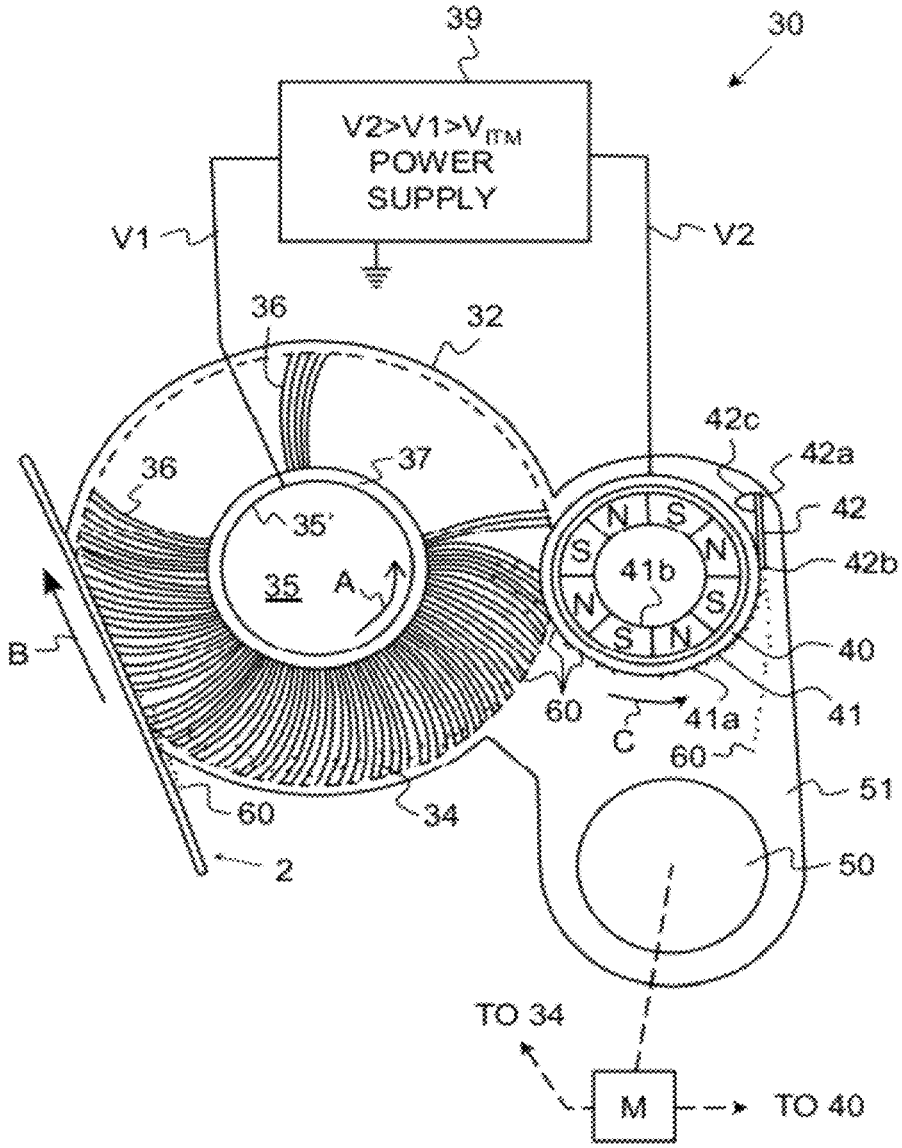
FIG. 1 is a side elevation schematic showing a cleaning apparatus utilizing a cleaning brush of the invention.

The preferred embodiments are described herein with reference to use of a cleaning brush in an electrophotographic copier or printer, but it will be understood that the invention can be used in any form of black and white or color electrostatographic copier or printer including electrographic copiers or printers. The description will be directed in particular to elements forming part of, or cooperating more directly with, the method in accordance with the present invention. It is to be understood that elements not specifically shown or described may take various forms well known to those skilled in the art.

In a typical electrophotographic printer, a primary image member, for example, a photoconductive web or drum, is uniformly charged at a charging station, and imagewise exposed at an exposure station, e.g., an LED printhead or laser electronic exposure station to create an electrostatic image. The image is toned by one or more toner or development stations to create a toner image corresponding to the color of toner in the station used. The toner image is transferred from primary image member to an intermediate transfer member, for example, an intermediate transfer roller or belt at a transfer station. The primary image member is cleaned at a cleaning station and reused to form more toner images of different color. One or more additional images may be transferred in registration with the first image transferred to create a multicolor toner image on the surface of the intermediate transfer member. The developer in the development station may be of the two-component type that includes electrically conductive magnetic carrier particles and electrically nonconductive or insulative dry toner particles. Other particles may be present in the developer as charge control agents, etc. as well known. Examples of development stations are described, e.g., in U.S. Pat. No. 5,196,887, the contents of which are incorporated herein by reference. However, the details of such stations are not critical to this invention.

The toner image on the intermediate transfer member is transferred to a receiving sheet such as paper or plastic which has been fed from a supply into transfer relationship with the intermediate transfer member at a transfer nip of a transfer station where the receiving sheet is brought into pressure contact with the image on the intermediate transfer member. The receiving sheet is then typically transported to a fuser where the toner image is fixed by conventional means. The cleaning brush of the present invention, and apparatus for cleaning residual toner from a toner-bearing surface employing such a cleaning brush, may be used in any type of conventional electrostatographic imaging apparatus, such as described in FIG. 1 of above referenced Maher et al., U.S. Pat. No. 6,009,301, the entire disclosure of which is incorporated by reference herein, as well as other conventional electrostatographic imaging apparatus, including apparatus employing multiple intermediate transfer rollers such as the Kodak NEXPRESS 2100, 2500, and 3000 series digital presses, and apparatus employing an intermediate transfer belt such as the Kodak NEXPRESS M700 digital press or Canon IMAGEPRO 7000. The details of such commercially available apparatus for which the cleaning apparatus of the present invention may be employed, however, are not critical to this invention.

With reference also now to FIG. 1, cleaning brush apparatus 30 comprises a housing 32 which encloses cleaning brush 34 having conductive fibers 36 which through an opening in the housing engage an intermediate transfer member (ITM) 2 (e.g., an intermediate transfer cylinder, drum, or continuous belt). In order to improve cleaning, an optional cleaning-assist charger may be provided upstream of the area where the cleaning brush contacts the ITM to charge the remnant toner and reduce attraction of the toner to the ITM.

The brush 34 is supported on a core 35 which is driven in rotation by a motor M or other motive source to rotate in the direction of the arrow A as the ITM is moved in the direction shown by arrow B. Alternatively, the direction of rotation of the brush may be the reverse direction than that shown. Brush core 35 itself may be conductive (resistivity less than $10^9$ ohm-cm), non-conductive (resistivity greater than $10^{12}$ ohm-cm), or partially conductive, but is preferably conductive. The brush further includes an electrically conductive (resistivity less than $10^9$ ohm-cm) plane 35' at the surface of the brush core, or a separate conductive layer (resistivity less than $10^9$ ohm-cm) is employed to provide the conductive plane, between the surface of the brush core and the electrically conductive fibers, effective for inducing an electrical potential to the conductive fibers when an electrical potential is applied to the electrically conductive plane. A relatively non-conductive (resistivity greater than $10^{12}$ ohm-cm) layer 37 electrically insulates the conductive plane 35' from the conductive fibers 36. The conductive plane 35' may be a surface of a conductive core such as a metal core, or it may be a conductive layer deposited on, adjacent to or surrounding the radius of the core. The conductive plane may also be a layer or layers coated to, adhered to, or adjacent the non-conductive plane, as further discussed below. The conductive plane is further adapted to induce an electrical potential to the conductive fibers when an electrical potential is applied to the conductive plane. The conductive plane may have a conductive path to a source to establish a potential on the conductive plane.

The non-conductive or insulative layer 37 may be an air gap, a polymer or other material layer, or a plurality of layers such that the non-conductive layer substantially insulates the conductive plane from the conductive fibers. A plurality of conductive, non-conductive, and semi-insulative planes may be employed provided there is at least one conductive plane and one non-conductive layer. The non-conductive layer preferably penetrates the fiber bundles and secures the fibers, typically with the aid of a woven mat. The non-conductive layer prevents the conductive layer from penetrating the fiber bundle and may serve to separate the conductive plane from the fiber bundle as previously described.

In the case of a plurality of layers there is preferably at least one non-conducting layer having a region where the thickness is between 10 microns and about 100 microns, more preferably between about 10 microns and about 50 microns, and most preferably between about 10 microns and about 30 microns.

As the brush rotates, untransferred toner particles 60 and other particulate debris, such as carrier particles and paper dust, on the ITM 2 are mechanically scrubbed from the ITM and picked up into the fibers 36 of the brush. The items illustrated in the figures are generally not shown to scale to facilitate understanding of the structure and operation of the apparatus. In particular, the brush fibers are shown much larger to scale than other structures shown in FIG. 1. In addition to mechanical scrubbing, an electrical bias is applied to the cleaning brush from power supply 39. The electrical bias V1 of the power supply 39 to the cleaning brush is, as will be more fully explained below, inductively, and not conductively, coupled to the brush fibers 36. The voltage V1 is greater than the voltage bias $V_{ITM}$ applied to the ITM. The polarity of the voltage on the brush fibers is such as to electrostatically attract toner 60 to the brush fibers. The toner particles 60 entrained within the fibers are carried to a rotating detoning roller 40 which is electrically biased by power supply 39 to a higher voltage level V2 than the voltage level. V1; i.e., the voltage level V2 is of a level to electrostatically attract the toner particles in the brush to the detoning roller. Assuming a positively charged toner image, as an example, the toner image may be attracted to the ITM which is biased to the voltage bias $V_{ITM}$ in the range of about-300 volts to about-1500 volts. The cleaning brush, in such an example would be biased to a potential V1 which is in the range of about-550 volts to about-1750 volts. The detoning roller in this example would be biased to a potential V2 which is in the range of about-800 volts to about-2000 volts. In considering relationships of voltage $V2>V1>V_{ITM}$, the absolute values of the voltages are implied.

The toner particles 60 are electrostatically attracted to the surface 41 of the detoning roller 40. The surface of detoning roller 40 is rotated in the direction of arrow C by a drive from motor M counter to that of brush fibers or alternatively in the same direction. The toner particles are carried by the surface 41 of the detoning roller towards a stationary skive blade 42 which is supported as a cantilever at end 42*a* so that the scraping end 42*b* of the blade 42 engages the surface 41 of the detoning roller. Toner particles scrubbed from the surface are allowed to fall into a collection chamber 51 of housing 32 and periodically a drive such as from motor M or other motive source is provided to cause an auger 50 or other toner transport device to feed the toner to a waste receptacle. Alternatively, the collection receptacle may be provided attached to housing 32 so that particles fall into the receptacle directly and the auger may be eliminated.

In order to ensure intimate contact between the detoning roller surface 41 and the skive blade 42, a permanent magnet 41*b* is stationarily supported within the hollow enclosure of the detoning roller. The skive blade is made of a metal such as ferromagnetic steel and is of thickness of less than 0.5 mm and is magnetically attracted by the magnet to the detoning roller surface 41. This effectively minimizes the tendency of the blades end 42*b* to chatter as the surface 41 travels past the blade end 42*b* and thus provides more reliable skiving of the toner and therefore improved image reproduction.

The skive blade extends for the full working width of the detoning roller surface 41 and is supported at its end 42*b* by ears 42*c* which are soldered to the blade. A pin extends through a hole in the ear portion to connect the skive to the housing. The detoning roller preferably comprises a toning or development roller as used in known SPD-type development stations which includes a core of permanent magnets surrounded by a metal sleeve 41*a*. As a detoning roller, the magnetic core is formed of a series of alternately arranged poles (north-south-north-south, etc.) permanent magnets 41*b* that are stationary when in operation. Sleeve 41*a* is formed of polished aluminum or stainless steel and is electrically conductive but nonmagnetic so as not to reduce the magnetic attraction of the skive blade to the magnets in the core. The sleeve is driven in rotation in the direction of arrow C and is electrically connected to potential V2. The use of a toning roller for the detoning roller as shown provides a magnet not only adjacent the skive blade but also adjacent the fiber brush. During development of the image, small amounts of magnetic carrier particles may escape from the development stations and be carried by the primary image member. Some may be transferred to the ITM 2. These particles may be removed from the ITM 2 by the fiber brush. The carrier particles represent a minor amount relative to the remnant toner and are removed from the fiber brush by magnetic attraction to the detoning roller. The magnetic core may be allowed to rotate freely to have the core magnets positioned through a rotational self-adjustment to provide maximum attraction of the skive blade to the detoning roller. The core can then be locked in place or allowed to maintain its self-adjusted position. The detoning roller may also comprise a roller having a rotating conductive sleeve with fewer internal magnets than the development roller since the presence of magnets is desirable at locations needed to attract carrier particles from the brush to the detoning roller and to attract the skive blade to the sleeve of the detoning roller. Though not required, the surface of the detone member may optionally be coated with an insulative layer to prevent ohmic contact with the conductive fibers.

Figure 2:
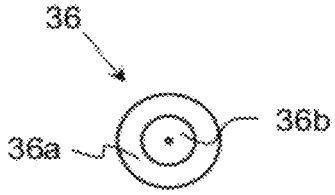
FIG. 2 illustrates a transverse cross-sectional view of a fiber, greatly enlarged and not to scale, the fibers being a preferred form for use in the cleaning apparatus of the invention.

With reference now to FIG. 2, a transverse cross-section of a fiber of the brush 34 is illustrated. The fibers each preferably include a non-conductive polymer peripheral portion 36*a* and a conductive central core portion 36*b*. The preferred fibers are formed of nylon, polyethylene terephthalate, or polybutylene terephthalate, and rendered conductive in the central core portion by impregnation with carbon black or other conductive particles. As is known in the art of fiber manufacture, carbon black, e.g., is melt spun with the filamentary polymer, such as nylon, in an amount sufficient to render the electrical resistivity of the fiber core from about $10^9$ ohm-centimeters or less. The core and sheath are formed simultaneously and the sheath portion of the fiber has a resistivity of about $10^{12}$ ohm-centimeters or greater and not does not contain sufficient amount of carbon black particles to provide conductivity. Representative commercially available core/shell fibers include, e.g., nylon fibers with doped cores under the designation F-7405 and known as RESISTAT from BASF Corporation, NEGA-STAT polyester fibers with doped cores from William Barnet & Sons (S.Car.), polybutylene terephthalate fibers with carbon doped cores from Unitika (Japan), and conductive core/shell fibers from Solutia, Inc. Preferred fibers are fibers in which the sheath and core comprises polyethylene terephthalate or more preferably polybutylene terephthalate.

The conductive fibers 36 may be secured to the brush in the form of fiber bundles with a woven mat with an adhesive or binder material penetrating the mat and the fiber bundles. In a preferred embodiment the adhesive is also the non-conductive plane 37. In still another preferred embodiment the conductive plane is a conductive coating applied to a non-conductive adhesive securing the fibers. In this embodiment, penetration of the conductive coating into the fiber bundles is prevented by the presence of the non-conductive binder. Additionally, the conductive plane may be in contact with or nearly in contact with the fiber bundle, but does not penetrate the fiber bundle due to the presence of the non-conductive plane.

Figure 3A:
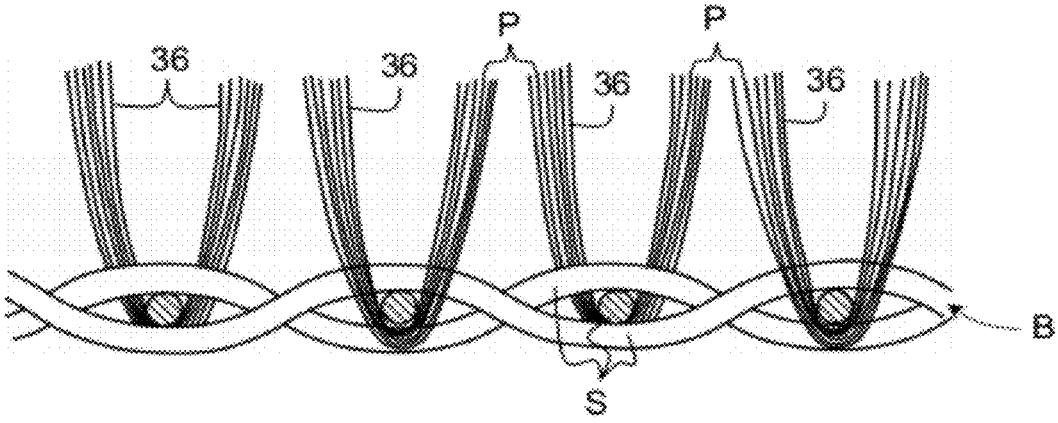
FIGS. 3A and 3B illustrate respectively a side elevation and a plan view in cross-section of one example of a weaving technique used in the cleaning brush of the invention.
Figure 3B:
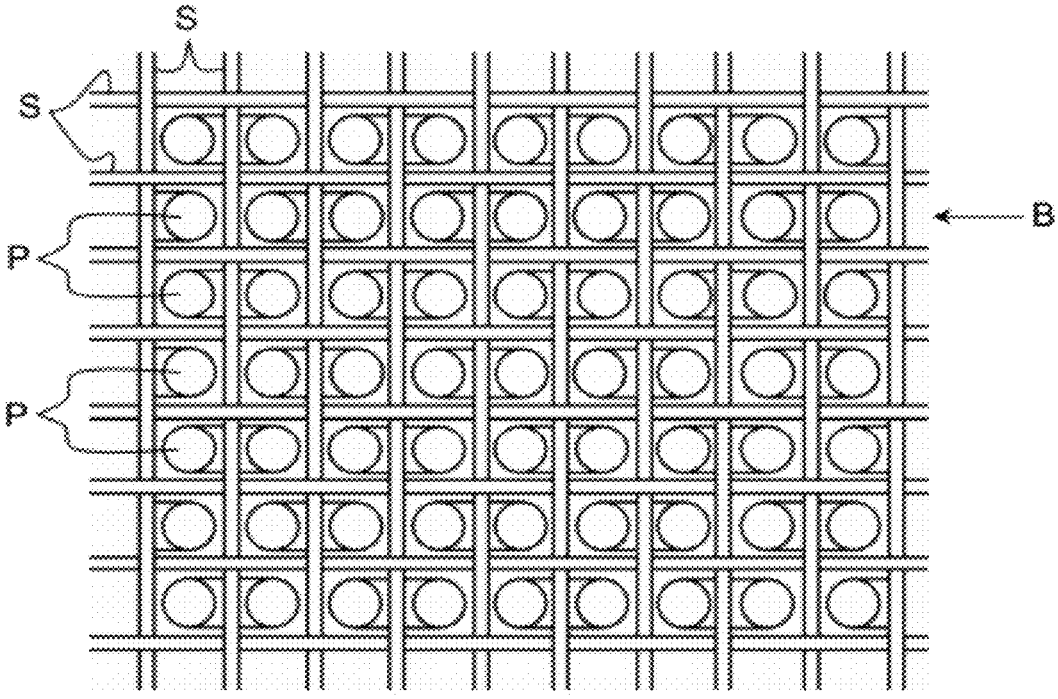
Figure 4A:
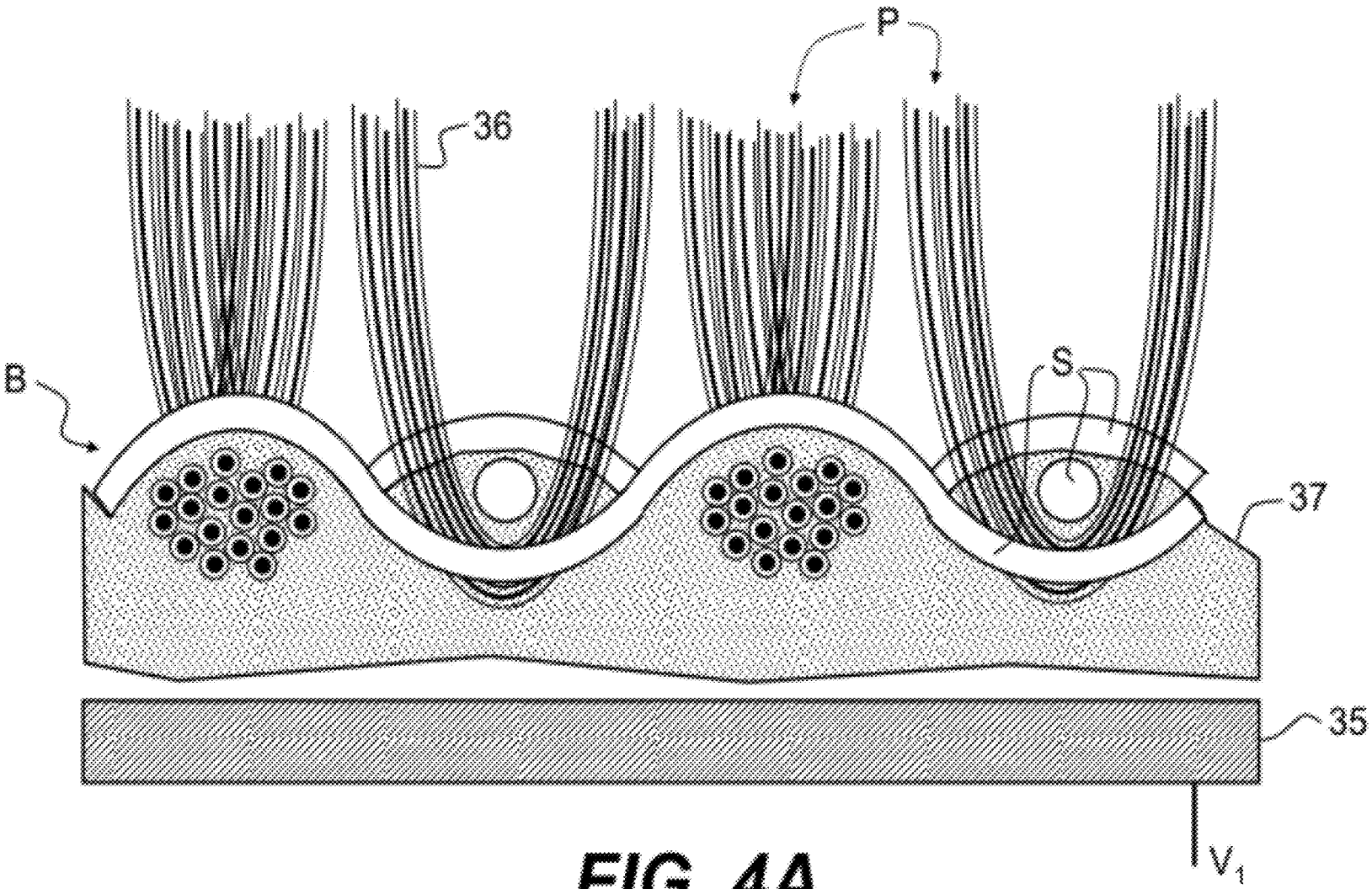
FIG. 4A illustrates a side elevation of one example of a weaving technique used in the cleaning brush of the invention in combination with a non-conductive layer.
Figure 4B:
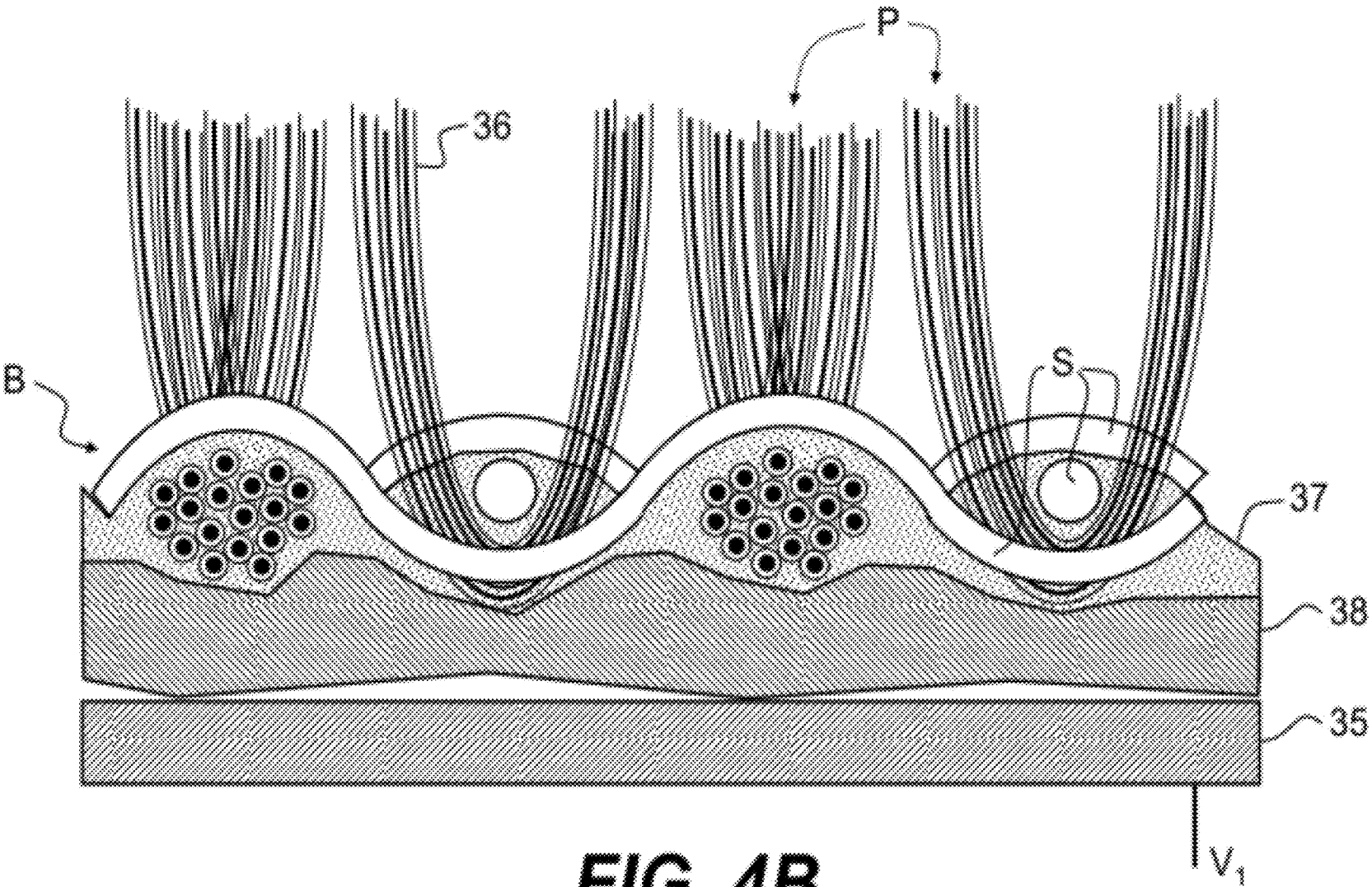
FIG. 4B illustrates a side elevation of one example of a weaving technique used in the cleaning brush of the invention in combination with a non-conductive layer and a conductive layer.

With reference now to FIGS. 3A and 3B, there is shown one example of weaving of the fibers 36 into fibers S of a fabric-based backing strip B to form a pile P as is well known. Other weaving techniques for forming the pile P may be used. As illustrated in FIG. 4A, in a preferred embodiment of the invention, a relatively non-conductive adhesive layer 37 is coated on the back of backing strip B. Non-conductive adhesive layer 37 penetrates the fiber bundles P and is in intimate contact with the individual fibers 36 of the fiber bundle, so as to additionally further electrically insulate the conductive plane 35' of brush core 35 from the conductive fibers 36 when the pile is mounted on the core 35. While in a one embodiment of the invention the core is electrically conductive and the conductive plane comprises the surface of the conductive brush core, a conductive layer 38, as shown in FIG. 4B, may alternatively or additionally be coated on the nonconductive layer prior to mounting on the core 35. In such a preferred embodiment, the non-conductive layer prevents penetration of the conductive layer into the fiber bundles, yet allows the conductive layer to remain in close proximity to the fiber cores for efficient induction of the conductive cores to occur.

In a preferred embodiment the conductive plane of the brush is adjacent to or directly in contact with the non-conductive layer 37. The conductive plane may be in close position to the fiber bundles, but does not penetrate the fiber bundles. The conductive plane is prevented from penetrating into the fiber bundles by the nonconductive layer, but is preferably not more than about 100 microns, and preferably not more than about 50 microns, from the periphery of the fiber bundles. The conductive plane is preferably less than about 30 microns, and even more preferably less than about 10 um from the periphery of the fiber bundles, and most preferably in contact with but not penetrating into the fiber bundles. The speed of the induce fiber voltage is approximately a function of e to the power (−t/L) where L is the distance of the conductive plane from the fiber core, so a smaller distance reduces the time to reach the peak induced voltage. While the use of fibers having a resistive fiber sheath should in theory prevent the flow of current, in practice brushes frequently operate close to the breakdown voltage of the fiber sheath and variations in the composition and processing of the sheath or processing of the brush can cause varying levels of leakage current, especially when employing a conductive layer coated on the backing. An additional problem is that during the initial onset of the voltage bias the insulating components of the brush can experience transient conductivity causing shutdowns in systems having simple fault detection algorithms. Such transient conductivity is thought to be dependent on the details of the fiber sheath composition and processing. These composition and processing details, being poorly understood, are thusly difficult to control during production and result in variation of the steady state and transient conductivity of various manufacturing lots. The present invention addresses such problems by employing a non-conductive layer to provide further electrical insulation between the conductive fibers and the conductive plane of the cleaning brush.

In another embodiment of the invention, the conductive fiber core at the fiber tip remote from the brush core may be coated, sealed, or otherwise provided with an insulative layer, or powder material layer, preventing contact of the conductive core with the toner-bearing surface to be cleaned or the surface of the detone member. The fiber tips may be sealed, e.g., by coating the cut tips of the fiber with a polymer or wax. The polymer may be solvent coated onto the tips of the fibers. The wax may be applied by contacting the cut brush against a wax containing surface, for example by rotating the brush against a wax block. The thickness of the coating may be from about 2 to about 50 microns. Alternatively, the fibers may be dusted with a powder compatible with the electrophotographic process prior to installation into the cleaning system. Compatible powders include toner powder and silica powders.

Typically, the cleaning brush has an outside diameter of about ½ to about 3 inches (about 1.2 cm to about 7.5 cm). The fiberfull density is of the order of 20,000 fibers to 150,000 fibers per square inch and preferably 75,000 to 100,000 of from about 5 to about 10 denier per filament fiber. The pile height of the brush may be from about 2 millimeters to about 20 millimeters and preferably is 3 mm.

In lieu of using the above described conductive fibers, the invention may employ the use of yarn-type fibers wherein a conductive fiber core is wrapped with a nonconductive sheath of microfibers. Fibers made of materials other than nylon may also be used.

In operation of an electrostatographic apparatus employing a cleaning apparatus of FIG. 1, toner images formed on a primary image member are transferred to ITM 2 by electrostatic attraction using applied fields as well as other forces such as preferential adhesion. An electrical bias is imparted to the ITM (or to the primary image member or both) to establish an electrical field in a transfer nip suited for transfer. The intermediate transfer member 2 may have a compliant layer that is semiconductive which is defined as having resistivity from about $10^8$ ohm-cm to about $10^{10}$ ohm-cm. A very thin hard overcoat or covering layer may cover the compliant layer and be relatively more insulating than the compliant layer but the effect of both layers in combination provides electrical conductivity of an intermediate level (resistivity of about $10^8$ ohm-cm to about $10^{10}$ ohm-cm) as is known in the prior art such as described in U.S. Pat. Nos. 5,084,735; 5,187,526; and 5,370,961. The conductive fiber brush engages the ITM 2 after transfer of the images(s) to a receiver sheet to remove untransferred toner remaining on the surface of ITM 2. The cores of the conductive fibers as described above are electrically biased to a higher potential than that provided to ITM 2. However, because the fibers bend when engaging the ITM 2, the insulating periphery of each of the fibers tends to engage the ITM 2 rather than the conductive core. This allows the fiber to establish an electrical field suitable for attracting toner to the brush with minimal current flow between brush fibers and ITM 2. Similarly and with reference to FIG. 1, both the brush fibers and detoning roller 40 are provided with different electrical biasing to attract toner from the brush to the detoning roller. Again, even though the surface 41 of the detoning roller 40 may be a metal and highly electrically conductive, there is a minimal electrical current provided by the power supply 39 because contact of the brush fibers with the surface 41 of the detoning roller is primarily with the insulating periphery 36*a* of each fiber rather than the conductive core 36*b* due to the bending of the fibers 36 against surface 41. In a further embodiment, current flow can be further reduced by coating the tips of the fibers with an electrically insulating material, and or coating the surface of the detone roller. Because of the minimum current flow, higher detone fields may be provided to effect greater cleaning of the brush by the detone roller.

Although the invention has been primarily disclosed above with specific reference to cleaning of an intermediate transfer member, the invention is also applicable to cleaning of transfer rollers, receiver backing rollers, receiver transport belts and rollers, and photoconductors and other members.

EXAMPLES

Comparative Example 1

Core shell fibers from Unitika (Japan) comprising a conductive core (resistivity less than $10^9$ ohm-cm) comprising polybutylene terephthalate containing carbon and an insulative polybutylene terephthalate shell (resistivity greater than $10^{12}$ ohm-cm), identified hereafter as Fiber Lot A, was woven into a strip. The strip was coated with a conductive coating (carbon loaded latex RA-512-16A-Black No. 1 from Heveatex Corp.) having a resistivity less than $10^9$ ohm-cm, at a coverage of 0.0076 g/cm$^2$, to bind the fibers, and the coated strip wound about an aluminum core and made into a cleaning brush.

Comparative Example 2

Brushes were prepared substantially as in Comparative Example 1 except that the fiber used was from a different lot of material from the manufacturer, hereafter identified as Fiber Lot B, Fiber Lot B being substantially identical to Fiber Lot A and made using substantially the same manufacturing process.

Example 1

Brushes were prepared substantially as in Comparative Example 2 except that the conductive coating was replaced with a non-conductive coating (RHOPLEX natural latex rubber from Heveatex Corp.) having a resistivity greater than $10^{12}$ ohm-cm, at a coverage of 0.0076 g/cm$^2$.

Example 2

Figure 4C:
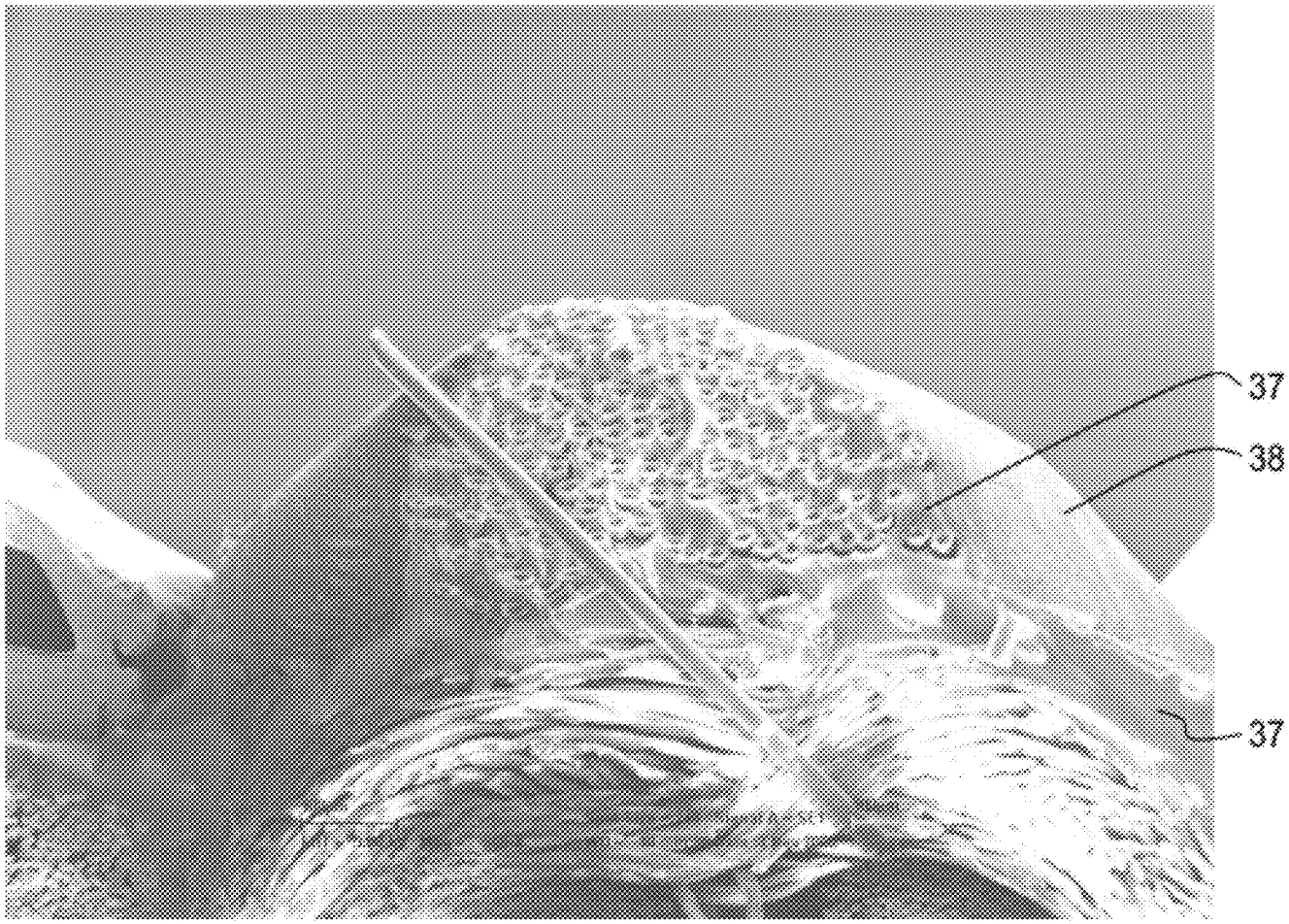
FIG. 4C illustrates an image obtained by scanning electron microscopy of a cross section of a brush backing in accordance with the embodiment of the invention obtained in Example 2.
Figure 5:
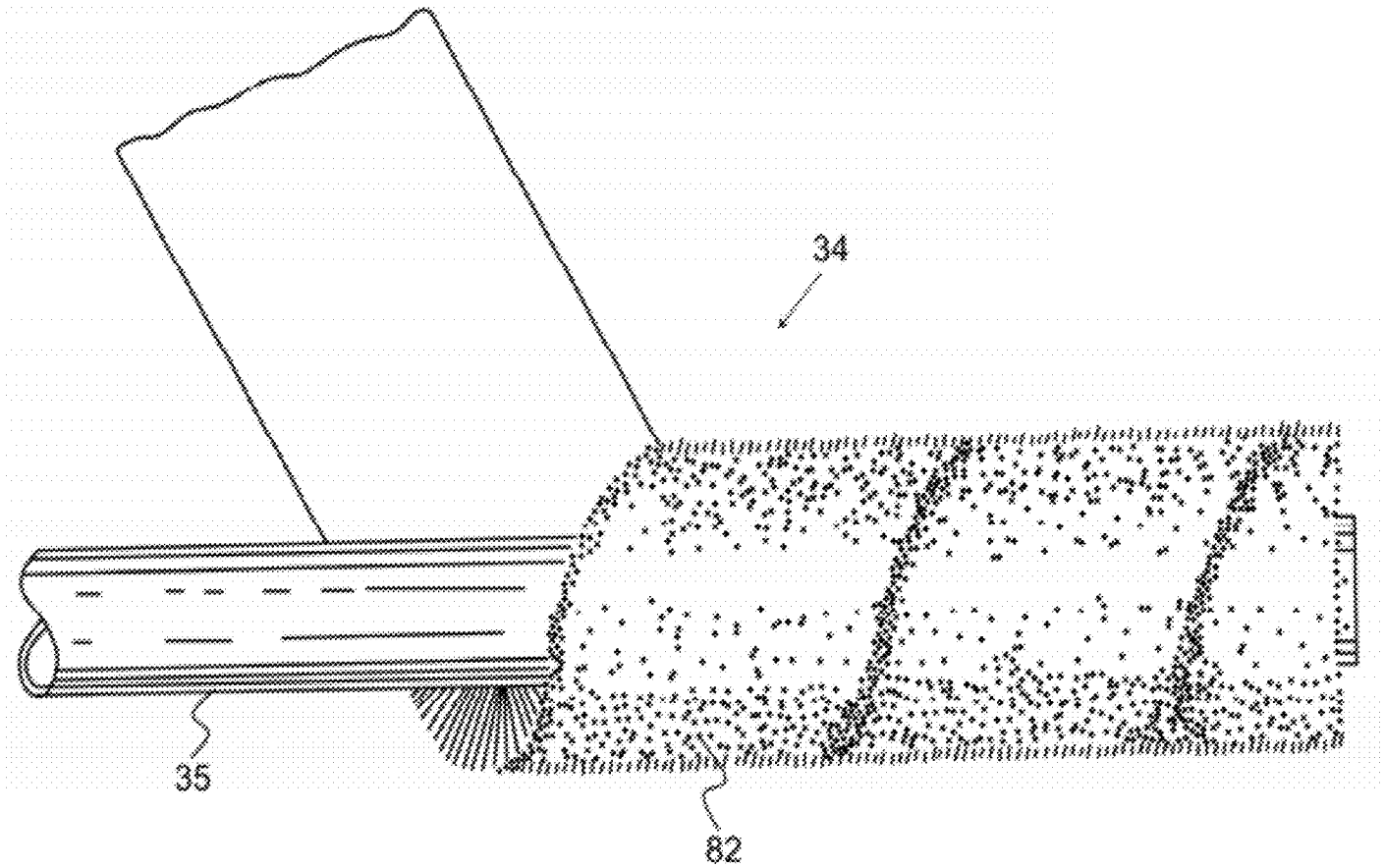
FIG. 5 is a view illustrating one technique for mounting the cleaning brush forming a part of the apparatus of the invention.

Brushes were prepared substantially as in Example 1 except that following the coating of the non-conductive coating, a conductive coating (carbon loaded latex RA-512-16A-Black No. 1 from Heveatex Corp.) having a resistivity less than $10^9$ ohm-cm, at a coverage of 0.003 g/cm$^2$, was further applied. Scanning electron microscopy shows that the first non-conductive coating 37 penetrates the fiber bundles, coats the fibers, and separates the subsequently coated conductive layer 38 from the fibers (FIG. 4C).

Example 3

The tips of finished brushes of Comparative Example 2 were coated with a heptane solvent solution of PICOTEX vinyl toluene/alpha-methylstyrene copolymer (from Hercules) to seal the conductive core that is otherwise exposed when the brushes are sheared during manufacturing.

Brush conductivity was evaluated in the following manner: A test fixture was constructed consisting of a cleaning station (with cleaning brush), cleaning station motor power supply, and two Cor-A-Trol's. One Cor-A-Trol was used to apply a constant 300V to the cleaning brush. The second Cor-A-Trol was used to apply a voltage to the detone roller, and to measure the current draw between the cleaning brush and detone roller. With the cleaning station motor running, the current draw was measured on the detone roller Cor-A-Trol at 100V increments starting a 0V and ending when the current draw exceeded the Cor-A-Trol ability to sink the current, or at the pre-determined limit of 1 KV.

Figure 6:
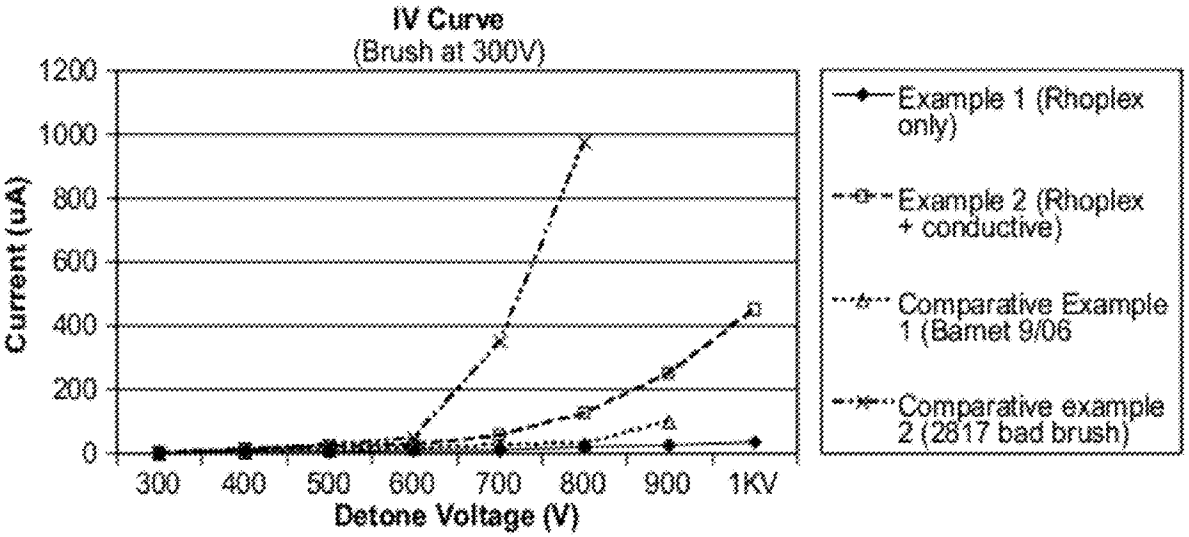
FIG. 6 is a chart illustrating current as a function of voltage between the brush and the detone shell for Examples 1 and 2 and Comparative Examples 1 and 2.

FIG. 6 illustrates the current as a function of voltage between the brush and the detone shell for Examples 1 and 2 and Comparative Examples 1 and 2. Current flow above about 200 uamps is problematic, and typical operating voltages are in the range of 600-800 volts. Brushes of Comparative Example 1 and Comparative Example 2 comprise essentially the same construction excepting that the lots of the fibers are different. Comparative Example 1 shows good performance, however Comparative Example 2 shows that changes in the fiber lots can cause poor performance and prevent use of the typical operating voltage range. Examination of the fiber lots show they have similar composition, construction, and chemical makeup as well as similar individual fiber electrical performance. In Example 1 of the current invention, fibers from the same lot used in Comparative Example 2 were used to prepare the brush. The brush of Example 1 using the brush core as the conductive plane and the fiber adhesive as the non-conductive plane shows good performance to beyond 1 KV and thus provides a much wider voltage operating window. The brush of Example 2 using a conductive coating as the conductive plane and the fiber adhesive as the non-conductive layer shows good performance to about 900 volts and thus provides a much wider voltage operating window. These results are summarized in Table 1, demonstrating that the brushes of Examples 1 and 2 show passing performance when made with the same fibers as the brush of Comparative Example 2.

TABLE 1

Brush Conductivity

| | Current at 700 V (uA) | Acceptance (uA <200) |
|---|---|---|
| Comp. Ex. 1 | 26 | Pass |
| Comp. Ex. 2 | 350 | Fail |
| Example 2 | 55 | Pass |
| Example 1 | 12 | Pass |

Figure 7:
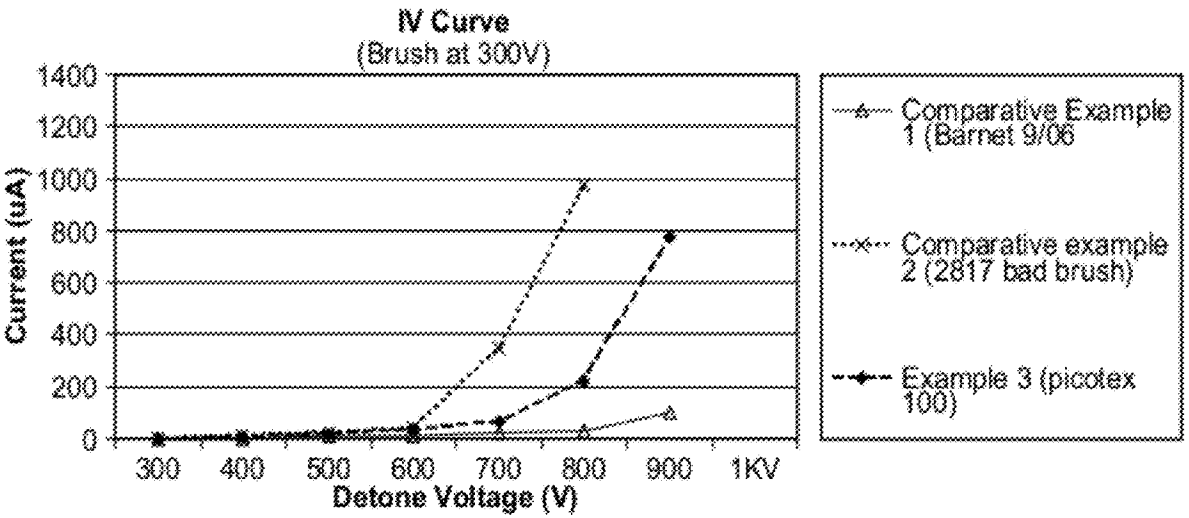
FIG. 7 is a chart illustrating current as a function of voltage between the brush and the detone shell for Example 3 and Comparative Examples 1 and 2.

In FIG. 7, comparisons of the Comparative Examples 1 and 2 are made with Example 3. The brush of Example 3 shows a dramatic improvement in the current draw at 700 and 800 volts. The results are summarized in Table 2 demonstrating that the brushes of Example 3 shows passing performance when made with the same fibers as the brush of Comparative Example 2.

TABLE 2

Coated Fiber Brush Conductivity

| | Current at 700 V (uA) | Acceptance (uA <200) |
|---|---|---|
| Comp. Ex. 1 | 26 | Pass |
| Comp. Ex. 2 | 350 | Fail |
| Example 3 | 65 | Pass |

Brush cleaning efficiency was evaluated in the following manner: Cleaning brushes as described in Examples 1 and 2 were employed in a cleaning brush system of an intermediate transfer roller blanket cylinder (BC) of a Kodak NEXPRESS 2100 electrophotographic digital printing press. A target consisting of in-track stripes of 100% dmax, non-imaged blank, 50% dmax, non-image blank, and 25% dmax is followed by a blank sheet. Twenty sets of the target sheets are run, and the last five blank sheets are measured for background by the RMSGS method in the corresponding 100% dmax, non-imaged blank, 50% dmax, non-image blank, and 25% dmax areas. For this measurement the lower the value, the lower background density image, representing a more effectively cleaned intermediate transfer roller. The RMSGS measurements, which yield weighted values corresponding to area coverage of background toner particles, were carried out using an image analyzer and algorithms similar to those described in Edinger, "The Image Analyzer—A Tool for the Evaluation of Electrophotographic Text Quality" in Journal of Imaging Science, 1987, Vol. 31, No. 4, pp 177-183, and Edinger, "Color Background in Electrophotographic Prints and Copies" in Journal of Imaging Science and Technology, 1992, Vol. 36, No. 3 pp 249ff, the disclosures of which are incorporated herein by reference. The background measurements for each striped area on the blank sheets are to be less then 1.6 RMSGS. The differential background level between the cleaned toned areas and the non-imaged blank areas on the blank sheets are to be less than 0.8 RMSGS. The results for Example 1 and Example 2 are shown in Table 3 and Table 4 respectively. All the toned areas have a differential RMSGS of below 0.8 indicating the brushes of example 1 and 2 have good cleaning performance.

TABLE 3

Brush Cleaning Efficiency (Non-conductive coating only) Example 1

| BC Detone-Brush Delta V | Blank Areas: Average RMSGS | 100% Toned Area: Differential Background RMSGS | 50% Toned Area: Differential Background RMSGS | 25% Toned Area: Differential Background RMSGS |
|---|---|---|---|---|
| 200 | 0.99 | 0.29 | 0.41 | 0.05 |
| 300 | 0.90 | 0.28 | 0.20 | −0.12 |
| 400 | 0.82 | −0.06 | −0.06 | 0.07 |
| 500 | 0.93 | 0.24 | 0.13 | −0.17 |
| 600 | 0.97 | 0.34 | 0.13 | −0.21 |

TABLE 4

Brush Cleaning Efficiency (Non-conductive + conductive coatings) Example 2

| BC Detone-Brush Delta V | Blank Areas: Average RMSGS | 100% Toned Area: Differential Background RMSGS | 50% Toned Area: Differential Background RMSGS | 25% Toned Area: Differential Background RMSGS |
|---|---|---|---|---|
| 200 | 0.78 | 0.39 | 0.22 | −0.04 |
| 300 | 1.09 | 0.17 | 0.11 | −0.16 |
| 400 | 0.95 | 0.22 | 0.15 | −0.22 |
| 500 | 0.74 | 0.31 | 0.22 | −0.06 |
| 600 | 0.77 | 0.28 | 0.28 | −0.13 |

Brush cleaning robustness was evaluated in a similar manner to brush cleaning efficiency, but in addition the transfer efficiency of the transfer member was degraded by lowering transfer current allowing increased amounts of toner from a Dmax image to enter the cleaning station. For the brushes of Example 1, the cleaning performance was acceptable at nominal conditions. However, at stress conditions that reflect aged parts, imperfect setup, or other noises, the cleaning performance degraded. In contrast, the brush of Example 2 maintained excellent cleaning performance under all stress conditions. This demonstrates the advantage of providing a minimal separation distance between the fiber bundles and the conductive layer.

The invention has been described in detail with particular reference to preferred embodiments thereof, but it will be understood that variations and modifications can be effected within the spirit and scope of the invention.

The invention claimed is:

1. A cleaning brush for use in an electrostatographic apparatus, comprising a plurality of individual electrically conductive fibers secured to a brush core and having fiber tips relatively remote from the brush core;

wherein the cleaning brush includes:

a) an electrically conductive plane between a surface of the brush core and the electrically conductive fibers, effective for inducing an electrical potential to the conductive fibers when an electrical potential is applied to the electrically conductive plane; and b) a relatively non-conductive layer electrically insulating the conductive plane from the conductive fibers;

wherein the electrically conductive fibers comprise an electrically conductive core and a surrounding relatively nonconducting annular portion, the fibers are woven into a non-conductive backing, the nonconductive backing is coated with a nonconductive adhesive layer which forms the non-conducting layer, the backing is adhered to the brush core, and the conductive plane comprises a conductive layer coated on the nonconductive adhesive layer.

2. The brush of claim 1, wherein electrically insulating coatings are on tips of the electrically conductive fibers remote from the brush core, covering the conductive core at the remote tips of the fibers.

3. The brush of claim 1 wherein the conductive core of the fibers has a resistivity of less than $10^9$ ohm-centimeters, and the annular portion has a resistivity greater than $10^{12}$ ohm-centimeters.

4. An apparatus for cleaning residual toner from a toner-bearing surface, comprising:

a cleaning brush comprising a plurality of individual electrically conductive fibers secured to a brush core and having fiber tips relatively remote from the brush core; wherein the cleaning brush includes: a) an electrically conductive plane between a surface of the brush core and the electrically conductive fibers, effective for inducing an electrical potential to the conductive fibers when an electrical potential is applied to the electrically conductive plane; and b) a relatively non-conductive layer electrically insulating the conductive plane from the conductive fibers;

a toner bearing surface contacting the brush fibers;

a drive for driving the cleaning brush to move the fibers relative to the toner bearing surface to scrub toner particles from the toner bearing surface; and a source of electrical potential coupled to the cleaning brush for establishing an electrical potential on the electrically conductive plane which induces an electrical potential to the fibers for electrostatically attracting toner from the toner-bearing surface to the brush;

wherein the electrically conductive fibers comprise an electrically conductive core and a surrounding relatively nonconducting annular portion, the conductive cores of the fibers have a resistivity of less than $10^9$ ohm-centimeters and the annular portions have a resistivity greater than $10^{12}$ ohm-centimeters, the fibers are woven into a non-conductive backing, which backing is adhered to the brush core, the nonconductive backing is coated with a nonconductive adhesive layer which forms the non-conducting layer, and the conductive plane comprises a conductive layer coated on the nonconductive adhesive layer.

5. The apparatus of claim 4 and including a detoning member having an electrically conductive metal surface in engagement with the brush, and a source of electrical potential coupled to the detoning member and electrically biasing the detoning member for attracting toner from the cleaning brush to the detoning member.

6. The apparatus of claim 4, wherein the toner bearing surface comprises an intermediate transfer member of an electrostatographic imaging apparatus.

7. A method of cleaning residual toner from a toner particle bearing surface, comprising:

providing a cleaning brush comprising a plurality of individual electrically conductive fibers secured to a brush core and having fiber tips relatively remote from the brush core; wherein the cleaning brush includes: a) an electrically conductive plane between a surface of the brush core and the electrically conductive fibers, effective for inducing an electrical potential to the conductive fibers when an electrical potential is applied to the electrically conductive plane; and b) a relatively non-conductive layer electrically insulating the conductive plane from the conductive fibers;

engaging the brush fibers to the toner bearing surface and moving the fibers relative to the surface to scrub toner particles from the surface to the brush; and establishing an electrical potential on the conductive plane which induces an electrical potential to the fibers that electrostatically attracts toner from the surface to the brush;

wherein the electrically conductive fibers comprise an electrically conductive core and a surrounding relatively nonconducting annular portion, the conductive cores of the fibers have a resistivity of less than $10^9$ ohm-centimeters and the annular portions have a resistivity greater than $10^{12}$ ohm-centimeters, the fibers are woven into a non-conductive backing, the nonconductive backing is coated with a nonconductive adhesive layer which forms the non-conducting layer, the backing is adhered to the brush core, and the conductive plane comprises a conductive layer coated on the nonconductive adhesive layer.

8. The method of claim 7 and including electrostatically attracting toner from the brush to a detailing roller, the detoning roller having an electrically conductive metal surface that is in engagement with the brush.

* * * * *